US008013819B2

(12) United States Patent
Ben-Shalom et al.

(10) Patent No.: US 8,013,819 B2
(45) Date of Patent: Sep. 6, 2011

(54) DRIVE SCHEME FOR A CHOLESTERIC LIQUID CRYSTAL DISPLAY DEVICE

(75) Inventors: Amir Ben-Shalom, Modiin (IL); Lahav Langboim, Rehovot (IL); Ilan Feldman, Moshav Sitriya (IL); David Coates, Wimbourne (GB)

(73) Assignee: Magink Display Technologies Ltd, Mevasseret Zion (IL)

( * ) Notice: Subject to any disclaimer, the term of this patent is extended or adjusted under 35 U.S.C. 154(b) by 1064 days.

(21) Appl. No.: 11/798,184

(22) Filed: May 10, 2007

(65) Prior Publication Data

US 2008/0042959 A1 Feb. 21, 2008

Related U.S. Application Data

(63) Continuation-in-part of application No. PCT/GB2005/004278, filed on Nov. 7, 2005.

(30) Foreign Application Priority Data

Nov. 10, 2004 (IL) ..... 1 651 50
Jun. 17, 2005 (GB) ..... 0512437.5

(51) Int. Cl.
*G09G 3/36* (2006.01)

(52) U.S. Cl. ..... 345/87; 345/88; 345/89

(58) Field of Classification Search ..... 345/94, 345/87, 88, 89

See application file for complete search history.

(56) References Cited

U.S. PATENT DOCUMENTS 5,193,015 A 3/1993 Shanks (Continued)

FOREIGN PATENT DOCUMENTS

EP 1 283 435 2/2003

(Continued)

OTHER PUBLICATIONS

J.Y. Nahm et al., "Amorphous Silicon Thin-Film Transistor Active-Matrix Reflective Cholesteric Liquid Crystal Display", Asia Display 98, pp. 979-982.

(Continued)

*Primary Examiner* — Richard Hjerpe
*Assistant Examiner* — Sahlu Okebato
(74) *Attorney, Agent, or Firm* — Pearl Cohen Zedek Latzer, LLP

(57) ABSTRACT

A cholesteric liquid crystal display device comprises three cells each comprising a layer of cholesteric liquid crystal material and an electrode arrangement capable of providing independent driving of a plurality of pixels across the layer of cholesteric liquid crystal material by respective drive signals. A drive circuit applies a respective drive signal to each pixel to drive the pixel into states which are variable to provide a reflectance varying within a predetermined range of reflectances. The drive signals involve a combination of two drive schemes to provide reflectances in different portions of the range. In particular, (a) when providing a reflectance in a first portion of higher reflectance, the drive signals comprise a first waveform shaped to drive the pixel into a stable state, the waveform having a shape which is variable to provide a stable state having a varying reflectance; and (b) when providing a reflectance in a second portion of lower reflectance, the drive signals comprise a second waveform shaped to drive the pixel into the homeotropic state and the planar state alternately, the periods of time during which the pixel is driven into the homeotropic and planar states being variable to provide a varying average reflectance as perceived by a viewer. Such a combination of drive schemes allows a good contrast ratio and color gamut to be achieved because of the use of the homeotropic state but only increases the power consumption by a relatively small amount as the homeotropic state is only used for a portion of the pixels.

44 Claims, 8 Drawing Sheets

U.S. PATENT DOCUMENTS

| | | | | |
|---|---|---|---|---|
| 5,235,448 | A | 8/1993 | Suzuki et al. | |
| 5,619,225 | A | 4/1997 | Hashimoto | |
| 5,661,533 | A | 8/1997 | Wu et al. | |
| 5,748,277 | A | 5/1998 | Huang et al. | |
| 5,796,447 | A | 8/1998 | Okumura et al. | |
| 6,094,249 | A | 7/2000 | Robinson et al. | |
| 6,317,189 | B1 | 11/2001 | Yuan et al. | |
| 6,414,669 | B1 | 7/2002 | Masazumi | |
| 6,507,331 | B1 | 1/2003 | Schlangen et al. | |
| 6,618,102 | B2 | 9/2003 | Harada et al. | |
| 6,717,561 | B1 * | 4/2004 | Pfeiffer et al. | 345/87 |
| 6,717,640 | B2 | 4/2004 | Sato et al. | |
| 6,816,138 | B2 * | 11/2004 | Huang et al. | 345/87 |
| 6,928,271 | B2 | 8/2005 | Fish et al. | |
| 7,205,970 | B2 | 4/2007 | Kim et al. | |
| 2001/0012080 | A1 | 8/2001 | Barberi et al. | |
| 2001/0026260 | A1 * | 10/2001 | Yoneda et al. | 345/98 |
| 2001/0045946 | A1 | 11/2001 | Huang et al. | |
| 2002/0003522 | A1 | 1/2002 | Baba et al. | |
| 2002/0093471 | A1 | 7/2002 | Roosendaal | |
| 2002/0149552 | A1 * | 10/2002 | Fish et al. | 345/88 |
| 2003/0034945 | A1 | 2/2003 | Mi et al. | |
| 2003/0151580 | A1 | 8/2003 | Ma | |
| 2004/0145549 | A1 * | 7/2004 | Johnson et al. | 345/87 |
| 2004/0246221 | A1 * | 12/2004 | Izumi | 345/94 |
| 2005/0083284 | A1 | 4/2005 | Huang et al. | |
| 2006/0007090 | A1 * | 1/2006 | Ben-Shalom et al. | 345/89 |
| 2006/0176410 | A1 * | 8/2006 | Nose et al. | 349/1 |
| 2008/0198173 | A1 | 8/2008 | Coates et al. | |
| 2009/0174643 | A1 | 7/2009 | Ben Shalom et al. | |
| 2009/0189847 | A1 | 7/2009 | Hughes et al. | |
| 2009/0303259 | A1 | 12/2009 | Shalom et al. | |

FOREIGN PATENT DOCUMENTS

| | | |
|---|---|---|
| WO | WO 98/50804 A2 | 11/1998 |
| WO | WO 01/88688 | 11/2001 |
| WO | WO 02/086855 | 10/2002 |
| WO | WO 02/103666 | 12/2002 |
| WO | WO 2004/030335 | 4/2004 |
| WO | WO 2007/042807 | 4/2007 |

OTHER PUBLICATIONS

I. Sage, Liquid Crystals Applications and Uses, Editor B. Bahadur, vol. 3, Chapter 20, pp. 301, 1992, World Scientific.

J.L. West et al., "Optimization of Stacks of Reflective Cholesteric Films for Full Color Displays", Asia Display, 1999, pp. 29-32.

W. Greubel et al., "Electric Field Induced Texture Changes in Certain Nematic/Cholesteric Liquid Crystal Mixtures", Molecular Crystals and Liquid Crystals, vol. 24, 1973, pp. 103.

D.K. Yang et al., "Switching Mechanism of Bistable Reflective Cholesteric Displays", SID Technical Digest, 1995, pp. 351-354.

J. Anderson et al., "Fast Frame Rate Bistable Cholesteric Texture Reflective Displays", SID Technical Digest, XXIX, 1998, pp. 806.

Kawata et al., "A High Reflective LCD with Double Cholesteric Liquid Crystal Layers", SID, 1997, pp. 246-249.

British Search Report for GB Application No. GB0512437.5 dated Aug. 30, 2005.

International Search Report for International Application No. PCT/GB2005/004278 mailed Mar. 20, 2006.

Huang, X Y et al., "Full Color (4096 Colors) Reflective Cholesteric Liquid Crystal Display," Proceedings of the 18th International Display Research Conference, Asia Display, vol. 98, 1998, pp. 883-886.

Non-final Office Action for U.S. Appl. No. 10/529,377 mailed on Sep. 18, 2007.

Final Office Action for U.S. Appl. No. 10/529,377 mailed on May 7, 2008.

Non-final Office Action for U.S. Appl. No. 10/529,377 mailed on Nov. 4, 2008.

Non-final Office Action for U.S. Appl. No. 10/529,377 mailed on Jul. 21, 2009.

Huang, X Y et al., "LP-1: Late News Poster: Gray Scale of Bistable Reflective Cholesteric Displays," Sid International Symposium Digest of Technical Papers, vol. 29, pp. 810-813.

* cited by examiner

Fully black

Grey level

Highest grey level

DRIVE SCHEME FOR A CHOLESTERIC LIQUID CRYSTAL DISPLAY DEVICE

CROSS-REFERENCE TO RELATED APPLICATIONS

This application is a Continuation In Part of PCT International Application No. PCT/GB2005/004278, entitled "DRIVE SCHEME FOR A CHOLESTERIC LIQUID CRYSTAL DISPLAY DEVICE", filed Nov. 7, 2005, which in turn claims priority from both UK Patent Application No. 0512437.5, filed Jun. 17, 2005 and from Israeli Patent Application No. 165150, filed Nov. 10, 2004, all of which are incorporated in their entirety herein by reference.

The present invention relates to a drive scheme for driving a cholesteric liquid crystal display device for providing a range of grey levels.

A cholesteric liquid crystal display device is a type of reflective display device having a low power consumption and a high brightness. A cholesteric liquid crystal display device uses one or more cells each having a layer of cholesteric liquid crystal material capable of being switched between a plurality of states. These states include a planar state being a stable state in which the layer of cholesteric liquid crystal material reflects light with wavelengths in a band corresponding to a predetermined colour. In another state, the cholesteric liquid crystal transmits light. A full colour display may be achieved by stacking layers of cholesteric liquid crystal material capable of reflecting red, blue and green light.

Most development of cholesteric liquid crystal displays has concentrated on use of the stable states of the liquid crystal material, these being the planar state providing a high reflectance and the focal conic state providing a low reflectance, as well as range of mixture states providing intermediate reflectances as a result of the liquid crystal material having domains in each of the planar and focal conic states. The use of the stable states provides the advantage of low power consumption as energy is only needed to drive the change of state, whereafter the liquid crystal remains in a stable state displaying an image without consuming power. All current commercially available cholesteric liquid crystal display devices work in this mode of operation.

For driving to display an image, the display device typically has an electrode arrangement capable of providing driving of a plurality of pixels across the layer of cholesteric liquid crystal material by respective drive signals.

A wide range of drive schemes have been proposed to selectively drive the liquid crystal material into a stable state having the desired reflectance in accordance with the image to be displayed. One drive scheme is to use a drive signal comprising a reset pulse waveform shaped to drive the pixel into the homeotropic state, followed by a relaxation period to cause the pixel to relax into the planar state, followed by a selection pulse waveform shaped to drive the pixel into a stable state, the selection pulse waveform being variable to drive the pixel into a stable state having a varying reflectance. By always driving the liquid crystal into the planar state, the form of the selection signal needed to provide the desired reflectance is predictable, thereby allowing accurate grey levels to be obtained. Other known drive schemes initially drive the pixel into the focal conic state.

Whilst use of the stable states provides a display device with a good contrast ratio, the contrast ratio is limited by the fact that the focal conic state scatters light and this has a reflectance of the order of 3-4%. It has been reported in J Y Nahm et al., Asia Display 1998 pp 979-982 and in WO-2004/030335 that a higher contrast ratio can be achieved by use of the homeotropic state of the cholesteric liquid crystal material which has a lower reflectance than the focal conic state. Thus use of the homeotropic state as the dark state instead of the focal conic state has the advantages of increasing the contrast ratio and improving the colour gamut. However, the homeotropic state is an unstable state and thus requires the continuous application of power to maintain display of an image. The homeotropic state has not been used in current commercially available displays.

In summary, the known cholesteric liquid crystal display devices do not provide a high contrast ratio and good colour gamut in combination with a low power consumption. However, this would be desirable.

According to a first aspect of the present invention, there is provided a method of driving a cholesteric liquid crystal display device which comprises at least one cell comprising a layer of cholesteric liquid crystal material and an electrode arrangement capable of providing independent driving of a plurality of pixels across the layer of cholesteric liquid crystal material by respective drive signals, the method comprising applying respective drive signals to each pixel to drive the pixels into states which are varied to provide a reflectance varying within a predetermined range of reflectances, the drive signals comprising:

(a) when providing a reflectance in a first portion of the predetermined range of reflectances, a first waveform shaped to drive the pixel into a stable state, the waveform having a shape which is variable to provide a stable state having a varying reflectance; and (b) when providing a reflectance in a second portion of the predetermined range of reflectances which is lower than the first portion, a second waveform shaped to drive the pixel into the homeotropic state and the planar state alternately, the periods of time during which the pixel is driven into the homeotropic and planar states being variable to provide a varying average reflectance as perceived by a viewer.

Thus the present invention employs a combination of two different drive schemes each to achieve a different portion of the range of desired reflectances. Thus the drive signal applied to a pixel depends on the desired reflectance of the pixel in accordance with the image to be displayed.

The first drive scheme used in the portion of higher reflectance is to apply a drive signal shaped to drive the pixel in question into a stable state. This drive scheme therefore only consumes power to change the image displayed. After the drive signal has been applied, the stable state is maintained and so the pixel continues to display the image without consuming power. Thus the power consumption is low for all pixels having a reflectance in the first portion of the range. This corresponds generally to the known driving of cholesteric liquid crystal display devices into a stable state, and indeed it is possible to use a known form of drive signal.

However to achieve a better contrast ratio and colour gamut, reflectances in the second portion of the range are provided by a second drive scheme. This drive scheme is to apply a drive signal shaped to drive the pixel into the homeotropic state and the planar state alternately. The periods of time during which the pixel is driven into the homeotropic and planar states is variable. The periods of time are sufficiently short that reflectance perceived by the viewer is a time average of the reflectance of the pixel in each of the homeotropic and planar states. The perceived reflectance is thus variable also, allowing the production of grey scales.

Accordingly, use of the second drive scheme improves the contrast ratio and colour gamut as compared to use of the first drive scheme by itself. Of course, the second drive scheme requires continuous application of a drive signal to drive the pixel into the homeotropic state because this is not a stable state. This increases the power consumption of the display device. However it has been appreciated that contrary to initial expectation the increase in the power consumption is actually quite low. This is because in practice the pixel needs to provide a reflectance in the second portion of the range relatively rarely. Ultimately this depends on the image to be displayed but it has been found for example that for a typical image displayed on the display device described in detail below, on average only 10-15% of the pixels need to be driven with the second drive scheme at any one time.

The first drive scheme may be of any type capable of driving the pixel into a stable state of variable reflectance. This includes various known drive schemes and new drive schemes which may de developed in the future.

The preferred first drive scheme is to use a first waveform which comprises: a reset pulse waveform shaped to drive the pixel into the homeotropic state, followed by a relaxation period to cause the pixel to relax into the planar state, followed by a selection pulse waveform shaped to drive the pixel into a stable state, the selection pulse waveform being variable to drive the pixel into a stable state having a varying reflectance. This drive scheme is in itself known. In this case, one option is that the selection pulse waveform has an amplitude which is variable, but there are other options for example using variable pulse widths.

The first drive scheme may use a selection pulse waveform comprising a single pulse but an alternative option is that the selection pulse waveform comprises an initial pulse shaped to drive the pixel into one of a plurality of initial stable states and, optionally, a tuning pulse shaped to drive the pixel into a final stable state having a reflectance between the reflectances of the initial stable states. The use of an initial pulse and a subsequent tuning pulse has been found in some cases to provide a greater selectivity of grey scales to be achieved than the use of a single pulse.

The second drive scheme operates on the same principle as the drive scheme disclosed by itself in WO-2004/030335. The drive scheme may use a second waveform which has any shaped capable of driving the pixel into the homeotropic and planar states. The preferred second waveform comprises one or more drive pulses shaped to drive the pixel into the homeotropic state alternating with one or more relaxation periods to cause the pixel to relax into the planar state. This drive scheme has the advantage of being straightforward to implement. It may be implemented on a frame basis in which said second waveform comprises, in each of a plurality of frames of predetermined duration, a single drive pulse shaped to drive the pixel into the homeotropic state followed by a relaxation period to cause the pixel to relax into the planar state.

Of course to provide the minimum possible reflectance it is possible that the drive signals further comprise: (c) when providing the minimum reflectance in the predetermined range of reflectances, a third waveform shaped to drive the pixel into the homeotropic state. Similarly to provide the maximum possible reflectance it is possible that the drive signals further comprise: (d) when providing the maximum reflectance in the predetermined range of reflectances, a fourth waveform shaped to drive the pixel into the planar state.

The drive signals may be applied on a frame basis, that is in successive frames of predetermined duration, the first and second waveforms each applied in a respective frame.

As mentioned above, the electrode arrangement is capable of providing driving of a plurality of pixels. The reason for this is the use of the second drive scheme which requires the continuous application of a drive signal when driving the pixel into the homeotropic state. Depending on the image, it is necessary to drive different pixels selectively in accordance with the second drive scheme which requires the possibility of driving pixels independently. The electrode arrangement may be of any type which allows this, including a direct drive arrangement or an active matrix drive arrangement.

According to a second aspect of the present invention, there is provided a cholesteric liquid crystal display device having a drive circuit arranged to apply a respective drive signal to each pixel in accordance with the method described above. In this case the drive circuit may be operable to select the drive scheme to be applied to each pixel in accordance with image data applied thereto.

To allow better understanding, a cholesteric liquid crystal display device which embodies the present invention will now be described by way of non-limitative example with reference to the accompanying drawings. In the drawings.

A cholesteric liquid crystal display device 24 in which the present drive scheme is implemented will now be described.

Figure 1:
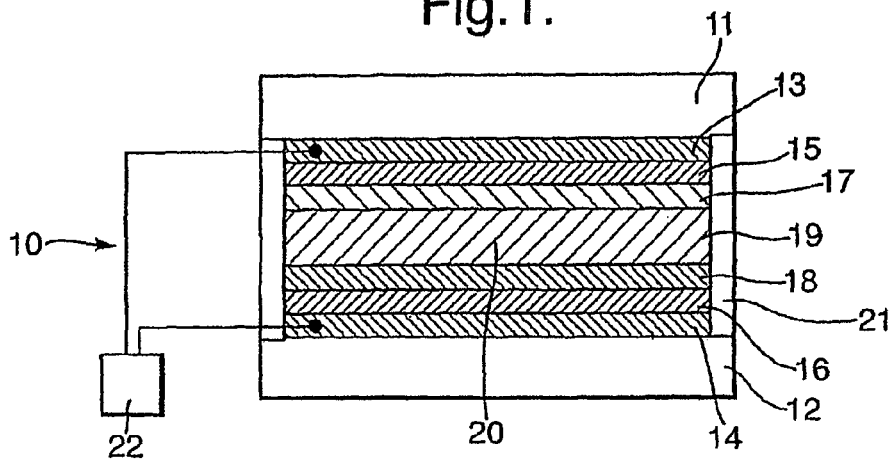
FIG. 1 is a cross-sectional view of a cell of a cholesteric liquid crystal display device.

FIG. 1 shows a single cell 10 which may be used in the cholesteric liquid crystal display device 24. The cell 10 has a layered construction, the thickness of the individual layers 11-19 being exaggerated in FIG. 1 for clarity.

The cell 10 comprises two rigid substrates 11 and 12, which may be made of glass or preferably plastic. The substrates 11 and 12 have, on their inner facing surfaces, respective transparent addressing layers 13 and 14 providing a rectangular array of addressable pixels, as described in more detail below.

Optionally, each addressing layer 13 and 14 is overcoated with a respective insulation layer 15 and 16, for example of silicon dioxide, or possibly plural insulation layers.

The substrates 11 and 12 define between them a cavity 20, typically having a thickness of 3 μm to 10 μm. The cavity 20 contains a liquid crystal layer 19 and is sealed by a glue seal 21 provided around the perimeter of the cavity 20. Thus the liquid crystal layer 19 is arranged between the addressing layers 13 and 14.

Each substrate 11 and 12 is further provided with a respective alignment layer 17 and 18 formed adjacent the liquid crystal layer 19, covering the respective addressing layer 13 and 14, or the insulation layer 15 and 16 if provided. The alignment layers 17 and 18 align and stabilise the liquid crystal layer 19 and are typically made of polyamide which may optionally be unidirectionally rubbed. Thus, the liquid crystal layer 19 is surface-stabilised, although it could alternatively be bulk-stabilised, for example using a polymer or a silica particle matrix.

The liquid crystal layer 19 comprises cholesteric liquid crystal material. Such material has several states in which the reflectivity and transmissivity vary. These states are the planar state, the focal conic state and the homeotropic (pseudo nematic) state, as described in I. Sage, Liquid Crystals Applications and Uses, Editor B Bahadur, vol 3, page 301, 1992, World Scientific, which is incorporated herein by reference and the teachings of which may be applied to the present invention.

In the planar state, the liquid crystal layer 19 selectively reflects a bandwidth of light that is incident upon it. The wavelengths λ of the reflected light are given by Bragg's law, ie $\lambda=nP$, where wavelength λ of the reflected wavelength, n is the refractive index of the liquid crystal material seen by the light and P is the pitch length of the liquid crystal material. Thus in principle any colour can be reflected as a design choice by selection of the pitch length P. That being said, there are a number of further factors which determine the exact colour, as known to the skilled person. The planar state is used as the bright state of the liquid crystal layer 19.

Not all the incident light is reflected in the planar state. In a typical full colour display device 24 employing three cells 10, as described further below, the total reflectivity is typically of the order of 30%. The light not reflected by the liquid crystal layer 19 is transmitted through the liquid crystal layer 19. The transmitted light is subsequently absorbed by a black layer 27 described in more detail below.

Figure 2:
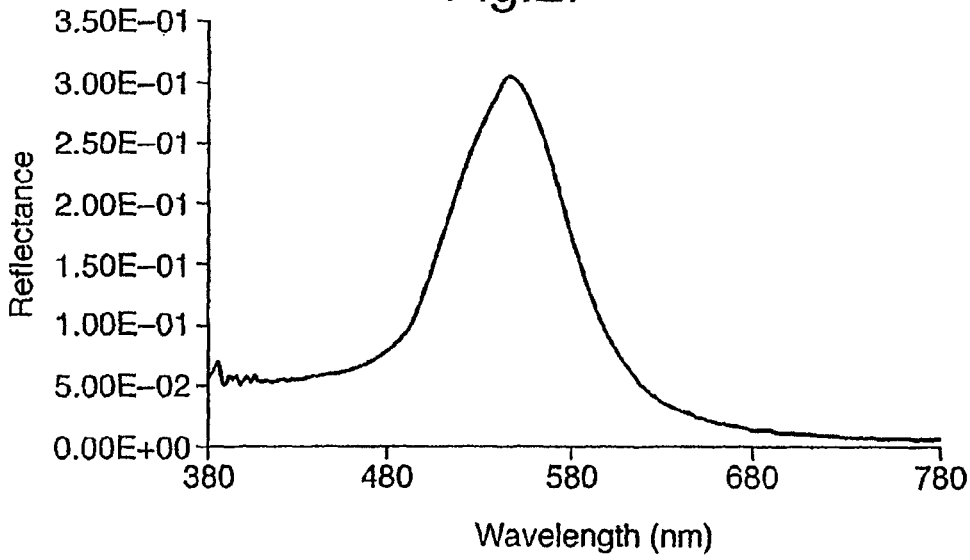
FIG. 2 is a graph of a typical reflectance spectrum of green cholesteric liquid crystal in the planar state.

The reflectance spectrum of the liquid crystal layer 19 in the planar state is shown in FIG. 2 for the example of reflection of green light. The reflectance spectrum has a central band of wavelengths in which the reflectance of light is substantially constant. This is due to the birefringence of the cholesteric liquid crystal material of the liquid crystal layer 19 and corresponds to reflection of light at different angles relative to the ordinary and extraordinary axes, the light at each angle seeing a different refractive index, which causes a different wavelength λ to be reflected.

In the focal conic state, the liquid crystal layer 19 is, relative to the planar state, transmissive and transmits incident light. Strictly speaking, the liquid crystal layer 19 is mildly light scattering with a small reflectance, typically of the order of 3-4%. As light transmitted through the liquid crystal layer is absorbed by the black layer 27 described in more detail below, this state is perceived as darker than the planar state.

In the homeotropic state, the liquid crystal layer 19 is even more transmissive than in the focal conic state, typically having a reflectance of the order of 0.5-0.75%. Use of the homeotropic state has the advantage of increasing the contrast ratio, as compared to use of the focal conic state.

A control circuit 22 supplies a drive signal to the addressing layers 13 and 14 which consequently apply the drive signal across the liquid crystal layer 19 to switch it between its different states. The actual form of the drive signal is described in more detail below, but two general points are to be noted.

Firstly, the focal conic and planar states are stable states which can coexist when no drive signal is applied to the liquid crystal layer 19. Furthermore the liquid crystal layer 19 can exist in stable states in which different domains of the liquid crystal material are each in a respective one of the focal conic state and the planar state. These are sometimes referred to as mixture states. In these mixture states, the liquid crystal material has a reflectance intermediate the reflectances of the focal conic and planar states. A range of such stable states is possible with different mixtures of the amount of liquid crystal in each of the focal conic and planar states so that the overall reflectance of the liquid crystal material varies.

Secondly, the homeotropic state is not stable and so maintenance of the homeotropic state requires continued application of a drive signal.

Figure 3:
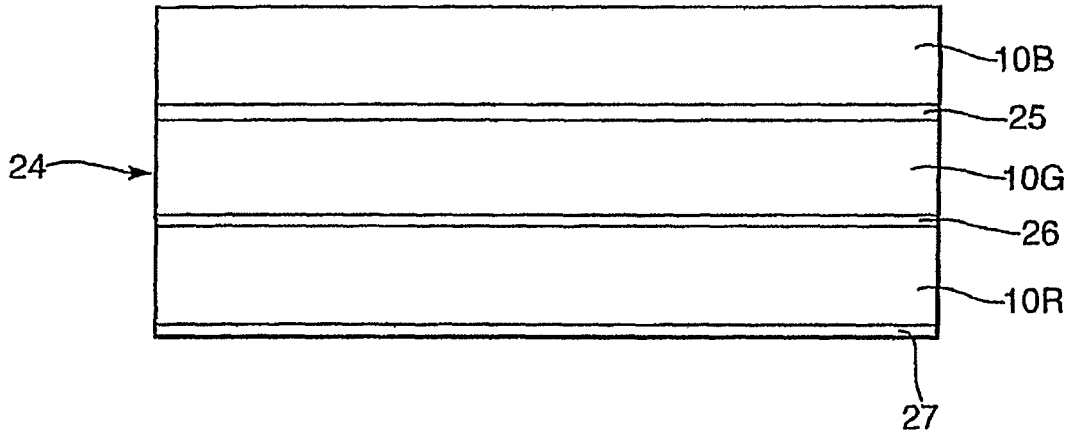
FIG. 3 is a cross-sectional view of the cholesteric liquid crystal display device.

FIG. 3 shows the display device 24 which comprises a stack of cells 10R, 10G and 10B, each being a cell 10 of the type shown in FIG. 1 and described above. The cells 10R, 10G and 10B have respective liquid crystal layers 19 which are arranged to reflect light with colours of red, green and blue, respectively. Thus the cells 10R, 10G and 10B will thus be referred to as the red cell 10R, the green cell 10G and the blue cell 10B. Selective use of the red cell 10R, the green cell 10G and the blue cell 10B allows the display of images in full colour, but in general a display device could be made with any number of cells 10, including one.

In FIG. 3, the front of the display device 24 from which side the viewer is positioned is uppermost and the rear of the display device 24 is lowermost. Thus, the order of the cells 10 from front to rear is the blue cell 10B, the green cell 10G and the red cell 10R. This order is preferred for the reasons disclosed in West and Bodnar, "Optimization of Stacks of Reflective Cholesteric Films for Full Color Displays", Asia Display 1999 pp 20-32, although in principle any other order could be used.

The adjacent pair of cells 10R and 10G and the adjacent pair of cells 10G and 10B are each held together by respective adhesive layers 25 and 26.

The display device 24 has a black layer 27 disposed to the rear, in particular by being formed on a rear surface of the red cell 10R which is rearmost. The black layer 27 may be formed as a layer of black paint. In use, the black layer 27 absorbs any incident light which is not reflected by the cells 10R, 10G or 10B. Thus when all the cells 10R, 10G or 10B are switched into a transmissive state, the display device appears black.

The display device 24 is similar to the type of device disclosed in WO-01/88688 which is incorporated herein by reference and the teachings of which may be applied to the present invention.

In each cell 10, the addressing layers 13 and 14 provides an electrode arrangement which is capable of providing independent driving of a rectangular array of pixels across the liquid crystal layer 19 by different respective drive signals. There are two alternative drive arrangements.

A first drive arrangement is a direct drive arrangement in which each pixel is directly driven by its own drive signal, as follows.

In the first drive arrangement, each addressing layer 13 and 14 is formed as a layer of transparent conductive material, typically indium tin oxide.

Figure 4:
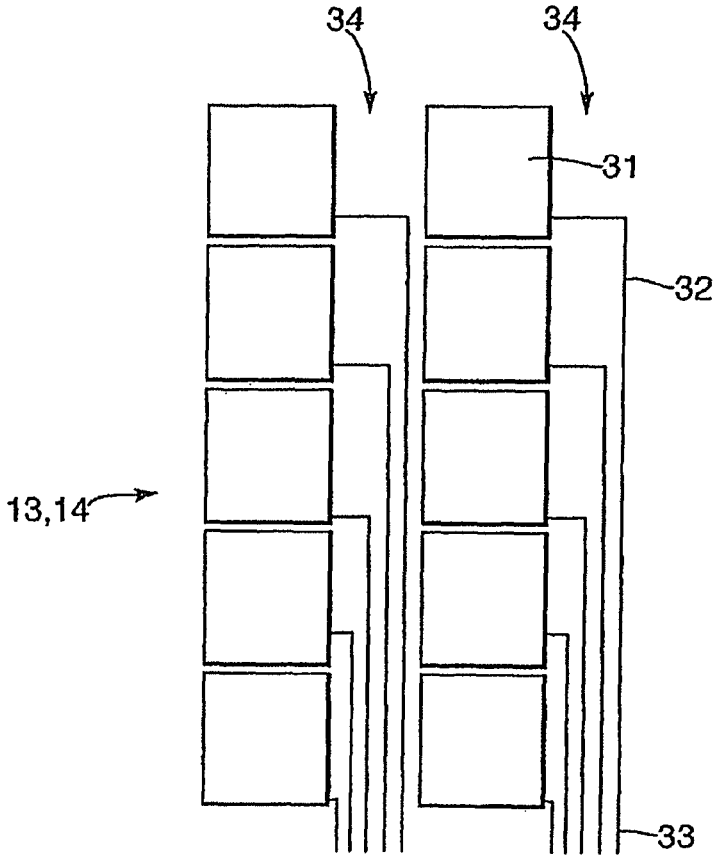
FIG. 4 is a plan view of the electrode arrangement of an addressing layer of the cell of FIG. 1.

A first one of the addressing layers 13 or 14 (which may be either of the addressing layers 13 or 14) is patterned as shown in FIG. 4 and comprises a rectangular array of separate drive electrodes 31. The other, second one of the addressing layers 13 or 14 extends over the area opposite the entire array of drive electrodes 31 and thus acts as a common electrode, although it could alternatively be divided to provide plural common electrodes each extending over a plurality of pixels.

The first one of the addressing layers 13 or 14 further comprises separate tracks 32 each connected to one of the drive electrodes 31. Each track 32 extends from its respective drive electrode 31 to a position outside the array of drive electrodes 31 where the track forms a terminal 33. The control circuit 22 makes an electrical connection to each of the terminals 33 and a common connection to the second one of the addressing layers 13 or 14. Through this connection, the control circuit 22 in use supplies a respective drive signal to each terminal 33 and thus the respective drive signals are supplied via the tracks 32 to the respective drive electrodes 31. In this manner, each drive electrode 31 is independently receives its own drive signal and drives the area of the liquid crystal layer 19 adjacent that drive electrode 31, which area of the liquid crystal layer 19 acts as a pixel. In this manner, an array of pixels is formed in the liquid crystal layer 19 adjacent the array of drive electrodes 31. As each drive electrode 31 receives a drive signal independently, each of the pixels is directly addressable.

Such direct addressing of each pixel is advantageous for a number of reasons. The electro-optic performance of the liquid crystal is improved as compared to passive multiplexed addressing because each pixel can be addressed independently without affecting or influencing the neighboring pixels. Also, direct addressing allows compensation of non-uniformity in the parameters of the cell over the area of the display device, for example variation in thickness of the liquid crystal layer due to the manufacturing process, or temperature variation across the display device. Each pixel can be driven with a drive signal adapted, for example by varying parameters such as voltage or pulse time to compensate those variations.

To accommodate the tracks 32 in the first one of the addressing layers 13 or 14, the drive electrodes 31 are arranged in lines (extending vertically in FIG. 4) with a gap 34 between each adjacent line of drive electrodes 31. The tracks 32 connected to a single line of drive electrodes 31 all extend along one of the gaps 34. All the tracks 32 from each drive electrode 31 in the line of drive electrodes 31 exit the array of drive electrodes 31 on the same side, that is lowermost in FIG. 4. As a result, all of the terminals 33 are formed on the same side of the display device 24. This has particular advantage when a plurality of identical display devices 24 are tiled to provide a larger image area because it reduces the gap needed between the individual display devices 24.

For clarity FIG. 4 illustrates the drive electrodes 31 and tracks 32 of only two lines of five pixels. The actual display device 24 may comprise a different number of pixels, more typically 36 lines of 18 pixels or larger. Most useful display devices will have at least three or preferably at least five pixels in each dimension.

The second drive arrangement is an active matrix drive arrangement in which each pixel is individually addressable, as follows.

Figure 14:
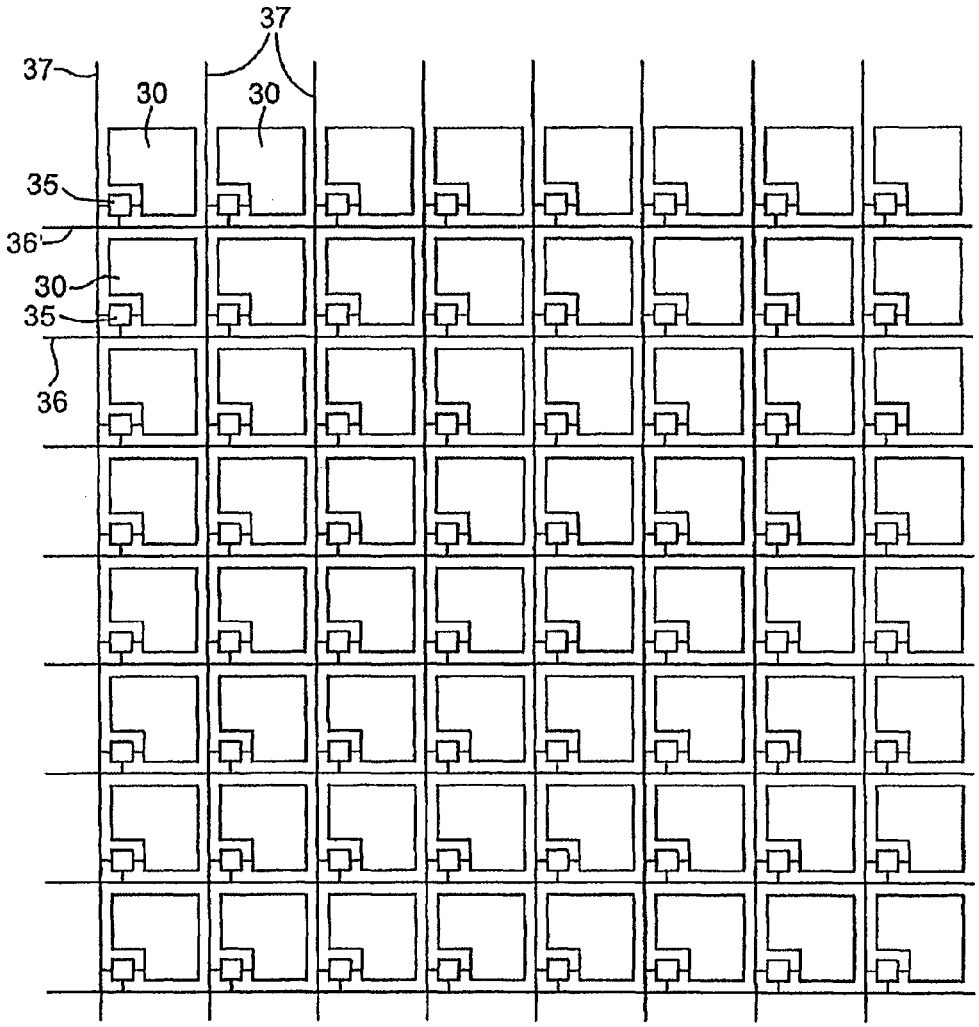
FIG. 14 is a plan view of a part of the active matrix drive arrangement across several pixels.
Figure 15:
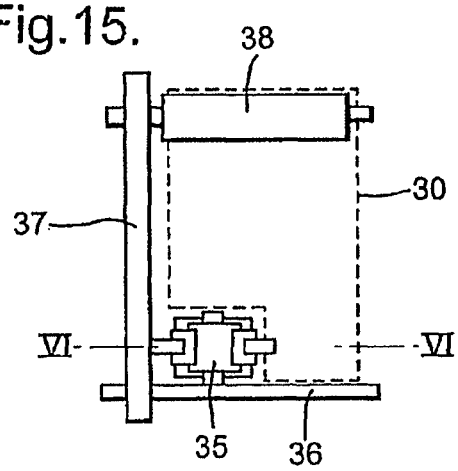
FIG. 15 is a detailed plan view of a part of the active matrix drive arrangement of a single pixel.
Figure 16:
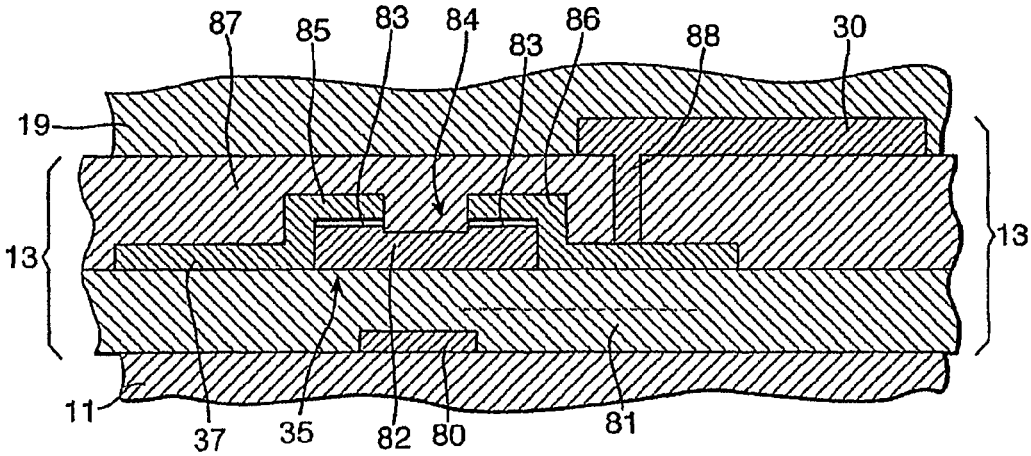
FIG. 16 is a cross-sectional view of the part of the active matrix drive arrangement of a single pixel shown in FIG. 15, taken along line VI-VI in FIG. 15.

One addressing layer 13 is formed with various components as shown in FIGS. 14 to 16, wherein FIG. 14 is a plan view across several pixels, FIG. 15 is a detailed plan view of the part of the active matrix drive arrangement in respect of single pixel and FIG. 16 is a cross-sectional view taken along the line VI-VI in FIG. 15. FIG. 14 and the further drawings illustrate only a part of the area of the display device 24 for clarity. In general, the display device 24 may comprise any number of pixels, the structure shown in FIGS. 14 to 16 being repeated across entire the display device 24.

The addressing layer 13 comprises an array of drive electrodes 30, each formed of transparent conductive material, typically ITO. Thus the array of drive electrodes 30 as a whole are formed by a patterned conductive layer. The drive electrodes 30 each drive a respective portion of the liquid crystal layer 19 which constitutes a respective pixel. The array of drive electrodes 30 is a two-dimensional, rectangular array. Thus, the drive electrodes 30 are arranged in two directions, horizontally and vertically in FIG. 14. Hereinafter, the horizontal lines of drive electrodes 30 will be referred to as rows and the vertical lines of drive electrodes 30 will be referred to as columns, but this terminology does not imply any particular orientation for the display device 24.

Of course, the drive electrodes 30 could alternatively be arranged in other two dimensional arrays, for example with rows offset from one another, or the drive electrodes 30 could be of other shapes.

The addressing layer 14 is formed as a continuous layer of transparent conductive material, typically indium tin oxide, extending across the entire array of drive electrodes 30 and hence across all the pixels, to act as a common electrode. The addressing layer 14 could be divided to provide plural common electrodes each extending over a plurality of pixels.

In principle, the cell 10 may be arranged in the display device 24 with either one of the addressing layers 13 and 14 towards the front, but usually the addressing layer 13 forming the active matrix drive arrangement is arranged towards the rear.

The addressing layer 13 is formed with a thin-film transistor 35 connected to each drive electrode 30, the drive electrodes 30 being rectangular in shape, except for a cut-out area in which the transistor 35 is situated. The transistor 35 acts as a switch device.

Each thin-film transistor 35 is arranged in the addressing layer 13 as follows. On the surface of the substrate 11 is provided a gate 80 of the transistor 35, tile gate being formed from a metal, or other conductor. The gate 80 is covered by a first passivation layer 81 made of an insulating material, typically SiN, and forming part of the addressing layer 13. Formed on the first passivation layer 81 is a body 82 of semiconductor material typically Si, having a doped layer 83 formed on top of the channel 81 with a central recess 84 aligned with the gate 80 and extending through the doped layer 83 to form a channel in the body 82 of semiconductor material through which current flows in operation. Formed over the body 82 of semiconductor material and the doped layer 83 at one end of the channel is a source 85 made of metal, or other conductor. Formed over the body 82 of semiconductor material and the doped layer 83 at the other end of the channel is a drain 85 also made of metal, or other conductor. The transistor 35 is covered by a second passivation layer 87 made of an insulating material, typically SiN, and forming part of the addressing layer 13. The drive electrode 30 is connected to the drain 86 by a contact 88 extending through the second passivation layer 87. The structure of the transistor 35 shown in FIG. 16 is a "bottom-gate" structure but alternatively a "top-gate" structure could be used.

The active matrix drive arrangement further comprises a first array of addressing lines 36 and a second array of addressing lines 37.

The addressing lines 36 of the first array extend between each row of drive electrodes 30, horizontally in FIG. 14. The addressing line 36 is connected to the gate 80 of every transistor 35 along a respective row of drive electrodes 30. The addressing lines 36 are made of metal, or other conductor, and typically deposited in the same process step as the gates 80 of the transistors 35. Thus, all the transistors 30 along a single row of drive electrodes 30 may be opened and closed by application of an addressing signal on a respective addressing line 36.

The addressing lines 37 of the second array extend between each column of drive electrodes 30, vertically in FIG. 14. The addressing line 37 is connected to the source 85 of every transistor 35 along a respective column of drive electrodes 30. The addressing lines 37 are made of metal, or other conductor, and typically deposited in the same process step as the sources 85 of the transistors 35. Thus, addressing signals applied to the addressing lines 37 charge the drive electrode 30 through any transistor 35 connected thereto which is closed by the addressing signal applied to an addressing line 36 of the first array.

In overview, each transistor 35 is individually addressable by a unique combination of an addressing line 36 of the first array and an addressing line 37 of the second array. The nature of the addressing signals is described further below.

In addition, there is a capacitor 38 connected to each drive electrode 30. The capacitors 38 are also connected to an addressing line 36 of the first array in respect of a different row of drive electrodes 30 from the drive electrode 30 to which the capacitor 38 is connected.

The active matrix drive arrangement has basically the same construction as is conventional for display devices using other liquid crystal effects such as twisted nematic (TN) or vertically aligned nematic (VA or VAN). The transistors 35 may be amorphous silicon (a—Si) transistors. Thus the active matrix drive arrangement may be manufactured using conventional techniques. The main modification is that the parameters of the transistors 35 such as the material thicknesses are optimised to charge the drive electrodes 30 with drive signals of a higher magnitude, that is typically of the order of 50-60V as opposed around 5V for twisted nematic liquid crystal material.

Although the active matrix drive arrangement employs thin-film transistors 35 as switch devices, any other type of switch device could alternatively be used such as a MIM switch.

Figure 5:
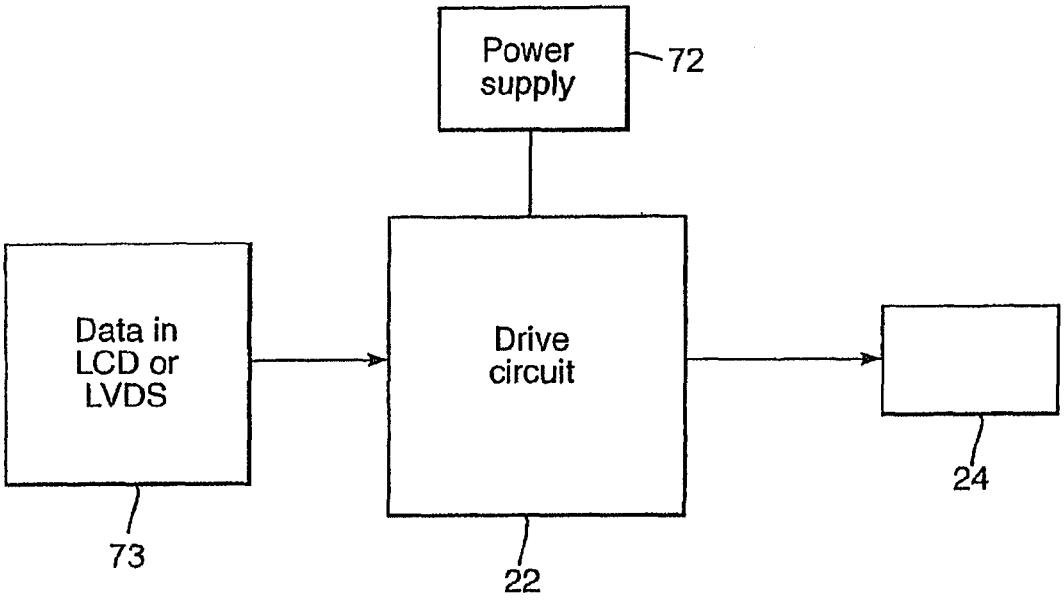
FIG. 5 is a diagram of the control circuit of the display device.

The control circuit 22 is further illustrated in FIG. 5. The control circuit 22 receives power from power supply 72. The control circuit 22 also receives image data representing an image from an image source 73. Typically the image data is in LCD format or LVDS format. The control circuit 22 derives a drive signal for each of the pixels of each of the cells 10R, 10G and 10B in accordance with the image data to cause the display device 24 to display the image by switching the liquid crystal material of each pixel into a state having an appropriate reflectance.

In the case of the direct drive arrangement shown in FIG. 4, the drive signals for each pixel are supplied to the respective tracks 32 for direct supply to the drive electrodes 31.

Figure 17:
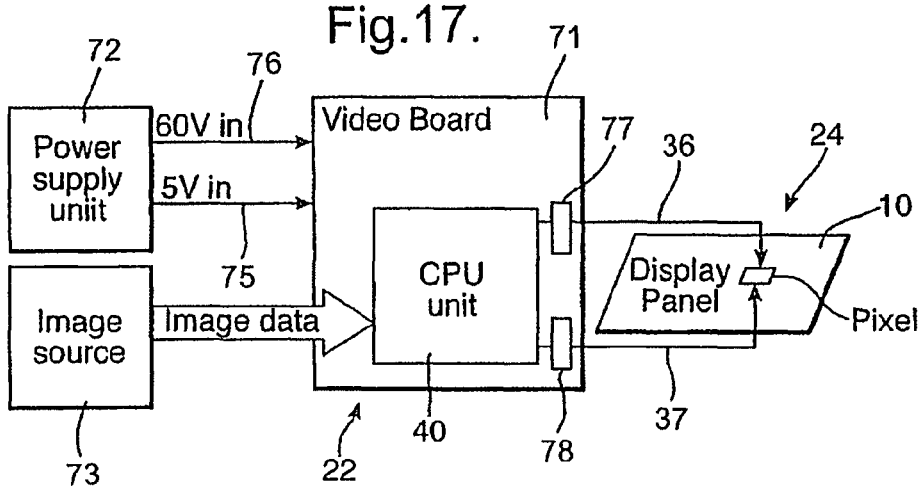
FIG. 17 is a diagram of the control circuit in the case of the active matrix drive arrangement.

In the case of the active matrix drive arrangement shown in FIGS. 14 to 16, the control circuit 22 is arranged as shown in FIG. 17 in which the first and second arrays of addressing lines 32 and 33 are shown schematically as a single line. The control circuit 22 is formed by a CPU unit 70 mounted on a video board 71 which is a printed circuit board. The video board 71 receives power from a power supply unit 72, in particular a 5V supply 75 which the video board 71 supplies to the CPU unit 70 and a 60V supply 76.

The CPU unit 71 receives the image data and in accordance therewith controls row driver circuits 77 to supply addressing signals to the first array of addressing lines 32 and column driver circuits 78 to supply addressing signals to the second array of addressing lines 33. These addressing signals address respective pixels of each of the cells 10R, 10G and 10B and produce a drive signal on the drive electrodes 30 which drives the pixels to cause the display device 24 to display the image by switching the liquid crystal material of each pixel into a state having an appropriate reflectance.

As an alternative to the use of a power supply unit 72 external to the video board 71, the video board may be arranged to receive power from a 24V supply by incorporating a low voltage regulator circuit to generate a 3-5V supply and a high voltage generator circuit to generate a 50-65V supply.

The form of the drive signals applied to each pixel is as follows.

Figure 6:
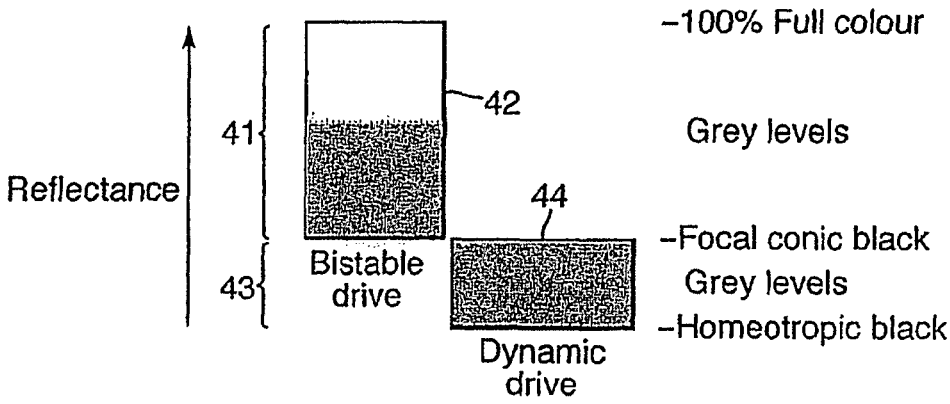
FIG. 6 is a schematic diagram illustrating the drive schemes used to drive pixels to different reflectances.

In a typical image, some of the pixels will be in a full bright state, some in a grey level and some in a fully dark state. Thus it is necessary to drive the pixels in each cell 10R, 10G and 10B into a range of reflectances, depending on the image data. For different portions of the range of reflectances, drive signals of two different forms are generated as shown schematically in FIG. 6, in which reflectance increases vertically. In particular, in a first portion 41 of the range of reflectances of higher reflectance, a drive signal is generated in accordance with a static drive scheme to achieve a reflectance as shown by the grey scale 42. On the other hand, in a second portion 43 of the range of reflectances of lower reflectance than the first portion, a drive signal is generated in accordance with a dynamic drive scheme to achieve a reflectance as shown by the grey scale 44.

The static drive scheme is used to drive pixels into a stable state, that is the planar state, the focal conic state or a mixed state having a reflectance between that of the planar and focal conic states. Thus the maximum reflectance of the first portion of the range is in the planar state, labeled as 100% full colour in FIG. 6, whereas the minimum reflectance of the first portion of the range is in the focal conic state, labeled as focal conic black in FIG. 6.

The dynamic drive scheme makes use of the unstable homeotropic state to drive pixels into a state having a lower reflectance than the focal conic state. In particular, pixels may be driven into the homeotropic state continuously to achieve a state of minimum reflectance, this being the minimum reflectance of the second portion of the range. To achieve higher reflectances in the second portion of the range, pixels are driven into the homeotropic state and planar state alternately.

The preferred form of the drive signals in the static and dynamic drive schemes is as follows.

In the static drive scheme, the drive signals are of a known form for driving cholesteric liquid crystal into a stable state with variable grey levels. This is a variant of the conventional drive scheme described first in W. Gruebel, U. Wolff and H. Kreuger, Molecular Crystals Liquid Crystals, 24, 103, 1973 and later in other documents.

Figure 7:
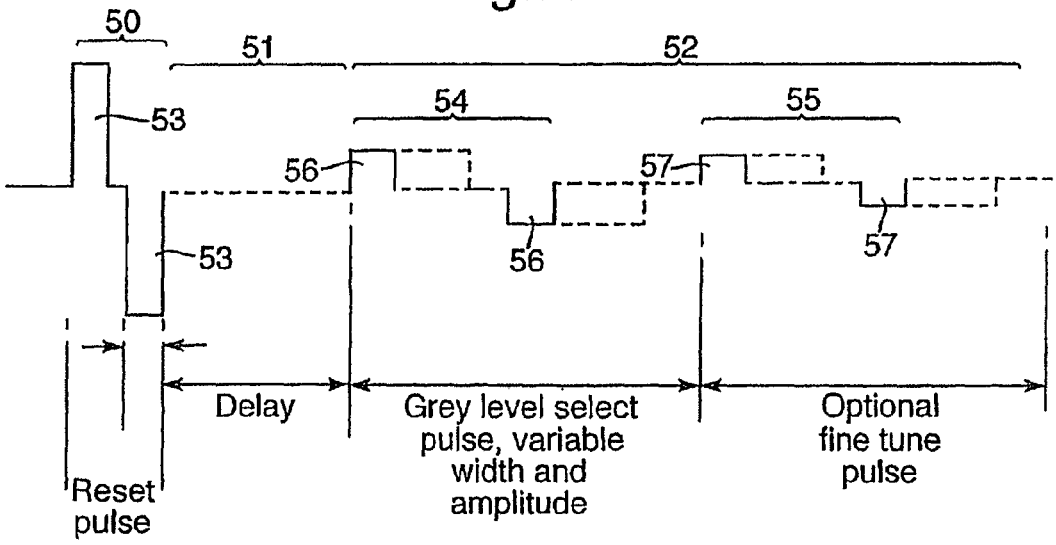
FIG. 7 is a graph of a drive signal in accordance with a static drive scheme.

The drive signal takes the form shown in FIG. 7 which is a graph of voltage over time. The drive signal comprises a reset pulse waveform 50, followed by a relaxation period 51, followed by a selection pulse waveform 52.

The reset pulse waveform 50 is shaped to drive the pixel into the homeotropic state. In this example, the reset pulse waveform 50 consists of a single balanced DC pulse which may equally be considered as two DC pulses 53 of opposite polarity.

The relaxation period 51 causes the pixel to relax into the planar state. The reset pulse waveform releases quickly so that the relaxation is into the planar state, rather than the focal conic state. The planar state forms within a short time period typically 3 ms to 100 ms depending on liquid crystal materials and alignment layers used. Accordingly the relaxation period is longer than this.

The selection pulse waveform 52 drives the pixel into a stable state having the desired reflectance. To achieve the maximum reflectance, the selection pulse waveform 52 is omitted altogether so that the drive signal consists only of the reset pulse waveform 50, followed by the relaxation period 51 to leave the pixel in the planar state. To achieve lower reflectances, the selection pulse waveform 52 comprises an initial pulse 54 optionally followed by a tuning pulse 55. In this example, the initial pulse 54 and the tuning pulse 55 each consist of a single balanced DC pulse. Thus the initial pulse 54 may equally be considered as two DC pulses 56 of opposite polarity and the tuning pulse 55 may equally be considered as two DC pulses 57 of opposite polarity.

Figure 8:
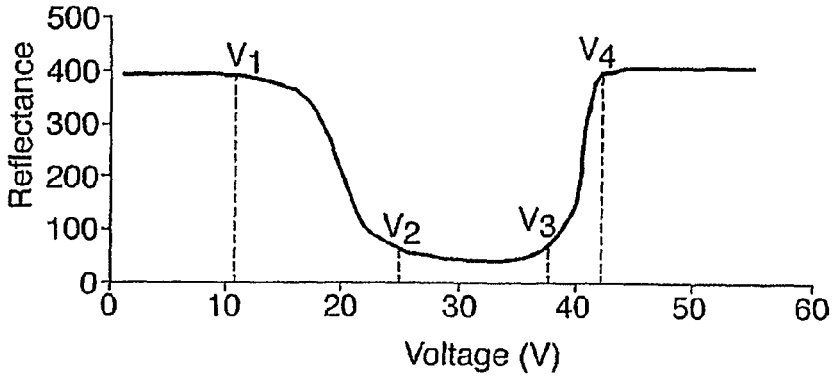
FIG. 8 is a graph of the electro-optical curve of a typical liquid crystal material.

The amplitudes of the initial pulse 54 and the tuning pulse 55 are variable to drive the pixel into a stable state having a correspondingly variable reflectance. This may be understood by reference to FIG. 8 which shows the electro-optical curve of a typical liquid crystal material. In particular, FIG. 8 is a graph of the reflectance (in arbitrary units) of a liquid crystal initially in the planar state (that is at the end of the relaxation period 52) after application of a pulse of variable amplitude (that is the initial pulse 54), the reflectance being plotted against the amplitude of that pulse. Thus the amplitude of the initial pulse 54 is selected at a point on the curve of FIG. 8 between V1 and V2 or between V3 and V4 to provide the desired reflectance.

Figure 9:
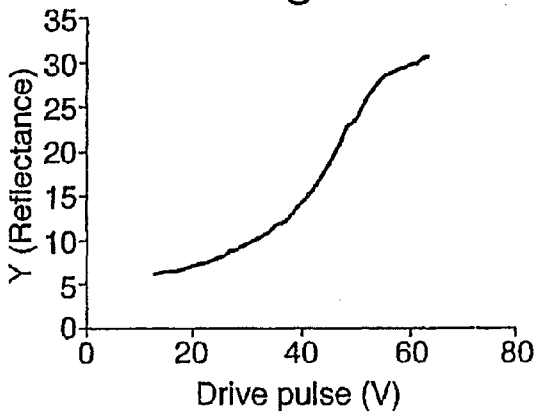
FIG. 9 is a graph of reflectance of the pixel against amplitude of a selection pulse with the drive signal of FIG. 7.

The slope of the curve between V1 and V2 or between V3 and V4 allows many grey level states to be achieved. For example, FIG. 9 is a graph of reflectance (arbitrary units) which may be achieved against the voltages of the initial pulse 54 of the selection pulse waveform for a liquid crystal material having the electro-optical curve of FIG. 8.

The tuning pulse 55 may be omitted so that the selection pulse waveform 52 comprises a single pulse, that is the initial pulse 54. As an alternative, the tuning pulse 55 may be included. In this case, the initial pulse 54 drives the pixel into an initial stable state and the tuning pulse 55 drives the pixel into a final stable state. The tuning pulse 55 preferably has a lower amplitude than the initial pulse 54. The advantage of using the tuning pulse 55 is that it can improve the resolution by allowing the pixel to reach a number of different final stable states between the initial stable states. This improves the static image quality.

In some implementations there is always a tuning pulse 55 regardless of the desired reflectance. In other implementations, the tuning pulse 55 is variably either (1) absent if the desired reflectance is equal to the reflectance of one of the initial stable states or (2) present if the desired reflectance is equal to the reflectance of one of the final stable states.

As an alternative to the amplitude of the selection pulse waveform 52 being variable, the duration of the initial pulse 54 and/or the tuning pulse 55 may be variable, as shown by the dotted lines in FIG. 7, to achieve a variable reflectance. This works in a similar manner to variation of the amplitude. This has the advantage of simplifying the drive circuit 22 as timing control is straightforward there is no need for a variable-voltage amplifier.

The actual amplitudes and durations of the reset pulse waveform 50 and the selection pulse waveform 52 vary in dependence on a number of parameters such as the actual liquid crystal material used, the configuration of the cell 10, for example the thickness of the liquid crystal layer, and other parameters such as temperature. As is routine in cholesteric liquid crystal display devices, these amplitudes and durations can be optimised experimentally for any particular display device 24.

Typically, the reset pulse waveform 50 might have an amplitude of 50V to 70V and a duration of from 0.6 ms to 100 ms, more usually 50 ms to 100 ms. Typically the initial pulse 54 and/or the tuning pulse 55 might have an amplitude of from 10V to 20V and a duration of from 0.6 ms to 100 ms. In one actual implementation, the drive signal comprises: a reset pulse waveform 50 of amplitude 65V and duration from 30 ms to 50 ms; a relaxation period 51 of duration 100 ms to 150 ms; an initial pulse 54 of amplitude 33V and duration varied from 0 ms to 51.2 ms to vary the reflectance; and no tuning pulse 55

In the above example, the pulses 52, 54 and 55 are all balanced DC pulses. In general any of these pulses 52, 54 and 55 may alternatively by DC pulses or AC pulses. In general it is preferred that the pulses are DC balanced to limit electrolysis of the liquid crystal layer 19 which can degrade its properties over time. Such DC balancing may be achieved by the use of balanced DC pulses, AC pulses or else DC pulses which are of alternating polarity in successive frames.

The drive signals of the static drive scheme are only supplied when the liquid crystal layer 19 is required to change reflectance. Thus the power consumption for pixels in the first portion of the range of reflectances is low.

Figure 10A:
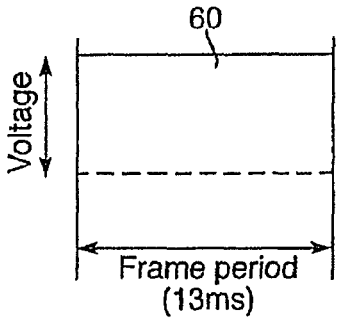
FIGS. 10A to 10C are graphs of a drive signal in accordance with a dynamic drive scheme.
Figure 10B:
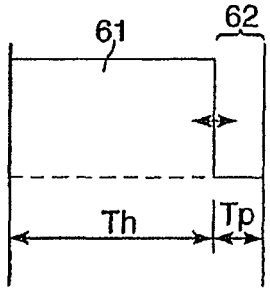
Figure 10C:
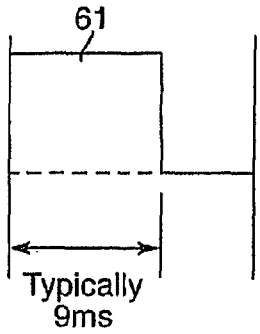

In the dynamic drive scheme, the drive signals take the form shown in FIGS. 10A to 10C which are graphs of voltage over time. These drive signals are supplied on a frame basis, that is the drive signals are applied each of successive frames of a predetermined duration. Typically, the frame period might be in the range from 10 ms to 30 ms, for example 13 ms as shown in FIG. 10A. The drive signals of the static drive scheme may be applied in the same frame period.

To drive the pixel into a state of minimum reflectance, the drive signal takes the form shown in FIG. 10A comprising drive pulse 60 which drives the pixel into the homeotropic state for the entire frame, that is continuously without allowing relaxation into the planar state.

To drive the pixel into a state of higher reflectance, the drive signal takes the form shown in FIG. 10B comprising drive pulse 61 of duration Th which drives the pixel into the homeotropic state and a relaxation period 62 of duration Tp which allows the pixel to relax into the planar state. Thus the pixel is driven into the homeotropic state and the planar state alternately. The durations Th and Tp are variable to vary the amounts of time spent by the pixel in the homeotropic and planar states. As a result of persistence of vision, the viewer perceives the pixel as having a reflectance which is the average of the reflectance over the entire frame. Thus the reflectance perceived by the viewer varies as the durations Th and Tp vary. This allows the production of grey levels in the second portion of the range of reflectances.

Figure 11:
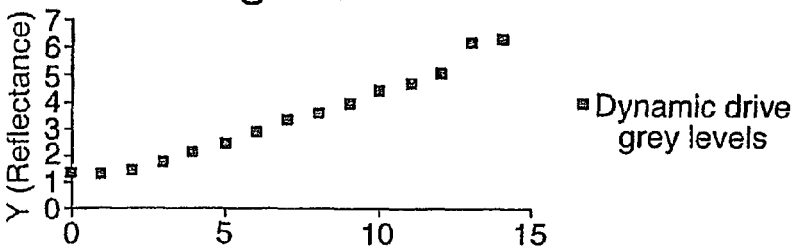
FIG. 11 is a graph of the reflectance of a pixel against the period of the drive pulse with the drive signal of FIGS. 10A to 10C.

In fact, the change in the reflectance over the frame is quite complicated. At the end of the drive pulse 61, the liquid crystal material of the pixel starts to change back into the stable planar cholesteric state within this cycle and reflects some light. This relaxation is a complex process and proceeds via a metastable transient planar state that has about twice the pitch length (in fact the pitch of transient planar texture is equal to K33/IC22× the pitch of final planar state where K33 is the liquid crystal bend elastic constant and K22 is the twist elastic constant) of the stable planar cholesteric phase (as explained for example in D-K Yang & Z-J Lu, SID Technical Digest page 351, 1995 and in J Anderson et al, SID 98 Technical Digest, XXIX page 806, 1998). Although this produces some non-linearity, it is nonetheless the case that the average reflectance increases with increase in the ratio of the amounts of time in the planar and homeotropic states, that is Tp/Th in this case. The actual change in reflectance is difficult to model but can be plotted by experiment. For example, FIG. 11 is a graph of the reflectance (arbitrary units) achievable for different durations Th and Tp for a cell 10 of the same type as that to which FIGS. 8 and 9 apply. In FIG. 11, the horizontal axis is the duration Tp of the relaxation period 62 measured as a number of time slots. Each time slot has a length of approximately 0.3 ms in this example so the maximum reflectance in FIG. 11 is achieved when the duration Tp of the relaxation period 62 is approximately 4 ms. More points could be plotted if desired.

Figure 12:
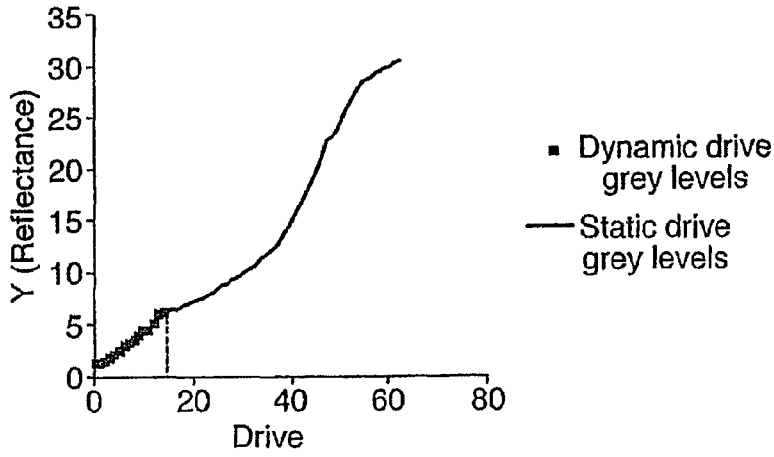
FIG. 12 shows the graphs of FIGS. 9 and 11 overlapping each other.

Furthermore, the selection of the durations Th and Tp is made so that the maximum value of the duration Tp of the relaxation period 62 provides the pixel with an average reflectance which is the maximum reflectance of the second portion of the predetermined range, that is equal to the reflectance of the focal conic state which is minimum reflectance of the first portion of the predetermined range. Again this is difficult to model but is easily determined by experiment in respect of the display device in question. For example, for a cell 10 of the type to which FIGS. 8 and 9 apply this might typically correspond to the duration Th of the drive pulse 61 being 9 ms. Thus it is possible for a continuous range of reflectances to be achieved by the static and dynamic drive schemes as shown for example in FIG. 12 which shows the graphs of FIGS. 9 and 11 overlapping each other.

In the drive signal shown in FIG. 10B, there is a single drive pulse 61 in each frame. This is preferred to minimise the power consumption and the stress on the liquid crystal material of the pixel. However, it is not essential to utilize a single pulse 61 in each frame and as an alternative, drive pulses may alternate with relaxation periods in each frame.

To facilitate digital implementation, the frame is divided into a predetermined number of time slots and the drive pulse 61 (or plural drive pulses, if used) are applied in a variable number of the time slots. This means that the change in reflectance occurs in discrete steps and thus the length of the time slots is chosen to provide an appropriate resolution in the resultant grey scale.

The amplitude of the drive pulses 60 and 61, and the frame duration, needed to drive the pixel into the homeotropic state in general vary in dependence on a number of parameters, in a similar manner to the parameters of the drive signal of the static drive scheme. The amplitude of the drive pulses 60 and 61 may be determined experimentally for a given display device 24 but the amplitude is typically in the range from 50V to 60V. In one actual implementation, the frame duration is 12.8 ms, and the drive pulses 60 and 61 are of amplitude 50V and of variable duration from 8.0 ms to 12.8 ms In FIGS. 10A to 10C, the drive pulses 60 and 61 are shown as unipolar pulses. For DC balancing, the drive pulses 60 and 61 have alternating polarity in successive frames. As an alternative to provide DC balancing, the drive pulses 60 and 61 may be AC pulses or balanced DC pulses.

In the case of the direct drive arrangement, the drive signals are generated in the form described above in the control circuit 22 and applied directly to the drive electrodes 31 via the tracks 32.

In the case of the active matrix drive arrangement, the drive signals applied to the drive electrodes 30 still take the form described above but this is achieved by scanning of the addressing lines 36 of the first array as follows.

Addressing signals are applied to the addressing lines 36 of the first array to successively scan the addressing lines 36. The addressing signal takes the form of an addressing pulse 50 of period $T_{ADDR}$ which is of sufficient magnitude to switch on (ie close) all of the transistors 35 connected to the addressing line 36 in question. Outside the addressing pulse 50, the addressing signal is at a low level (typically 0V) which switches off (ie opens) the transistors 35 connected to the addressing line 36 in question. Addressing signals of the same form are applied to each addressing line 36 with the pulses staggered to scan each addressing line 36 successively. The pulse is repeated after a scan period $T_{AM}$ in which the entire first array of addressing lines 36 has been scanned.

Addressing signals are applied to the addressing lines 37 of the second array to address the pixels of each row as it is scanned by the addressing signals applied to the addressing lines 36 of the first array. Thus the addressing signals applied to each addressing line 37 are updated every period of duration $T_{ADDR}$.

The addressing signals applied to each one of the addressing lines 37 are thus applied to the drive electrode 30, through the transistor 35 which has been closed by the addressing signals applied to the addressing line 32 of the first array. Thus the addressing signal applied to each addressing line 37 is either a drive pulse of sufficient magnitude to charge the drive electrode 30 or else of low amplitude, typically at or close to 0V, to discharge the charge on the drive electrode 30. After the end of the period $T_{ADDR}$ of the addressing pulse 50, the signal appearing on a given drive electrode 30 is then held for the remainder of the scan period $T_{AM}$ until the drive electrode 30 is addressed again. In this way the drive voltage on each drive electrode 30 can be updated with a temporal resolution of the scan period $T_{AM}$. Accordingly, the addressing signals applied to each one of the addressing lines 37 are varied to provide the drive signals on each pixel of the form described above.

There are some practical limitations as follows.

The three key parameters of the transistor 35 are mobility (0.3 $cm^2/Vs$ taken here), channel length (6 μm taken here) and metal bus bar, i.e. row/column resistivity (0.2 Ω/square taken here). In addition, it is assumed that voltage errors resulting from the pixels not fully charging can be much larger than for current active matrix addressing arrangements for liquid crystal display devices. The period $T_{ADDR}$ of the addressing pulse 50 must be sufficiently long to charge a drive electrode to a the desired voltage, this charging being exponential. In the case of the static drive scheme, where duration of the initial pulse 54 is varied, relatively low errors in the voltage are acceptable. In thin-film transistor design it is difficult to get the pixel voltage to hit the required voltages exactly and some tolerance is allowed. Using these parameters gives a minimum period $T_{ADDR}$ of the addressing pulse 50 of about 25 μs.

In the case that the duration of the initial pulse 54 in the static drive scheme is varied to vary the reflectance of a pixel, then the duration of the initial pulse 54 needs to be varied with a resolution of 0.2 ms in order to provide 32 grey levels, for typical properties of the layer of the liquid crystal layer 19. This means that the maximum duration of the scan period $T_{AM}$ is 0.2 ms.

The ratio of the maximum duration of the scan period $T_{AM}$ to the minimum period $T_{ADDR}$ of the addressing pulse 50 gives the number R of addressing lines 36 in the first array which may be scanned in each scan period $T_{AM}$. For the typical figures just mentioned, this means the number R of addressing lines 36 in the first array which may be scanned in each scan period $T_{AM}$ is eight. This limits the size of the array of pixels. However, the number R of addressing lines 36 in the first array which may be scanned in each scan period $T_{AM}$ may be improved in a number of ways as follows.

One possibility is to modify the active matrix drive arrangement using the techniques described in WO-2007/042807 with reference to FIGS. 9 to 12 of that document. Accordingly, WO-2007/042807 is incorporated herein by reference. In one technique the first array of addressing lines 36 are divided into plural groups which are scanned in parallel. For example a division into four groups multiplies the number R of addressing lines 36 in the first array which may be scanned in each scan period $T_{AM}$ by four. Another technique is to use spatial modulation in addition to temporal modulation.

Another possibility is to reduce the resolution of the initial pulse 54, ie to increase the maximum duration of the scan period $T_{AM}$. This correspondingly decreases the number of grey levels attainable by the static drive scheme but that is acceptable for some applications. For example the resolution may be doubled to 0.4 ms which doubles the number R of addressing lines 36 in the first array which may be scanned in each scan period $T_{AM}$ but reduces the number of grey levels to 16.

A final possibility is to vary the design of the transistors 35, or use an alternative technology for the transistors 35, in order to provide faster charging of the drive electrodes 30 so that the period $T_{ADDR}$ of the addressing pulse 50 can be reduced.

The advantage of the use of the dynamic drive scheme in combination with the static drive scheme improves the contrast ratio and the colour gamut. Considering the static drive scheme, the focal conic state is the dark state but this still scatters light typically having a reflectance of from 3% to 4%. As a result the contrast ratio of the liquid crystal layer 19 is typically from 10 to 15, and with a conventional multiplex addressing electrode arrangement this gives an overall contrast ratio for the cell 10 of from about 6 to 8. However, use of the dynamic drive scheme allows use of the homeotropic state as the dark state. As the homeotropic state has a very low reflectance, this improves the contrast ratio. For example, the contrast ratio of the liquid crystal layer 19 is typically 50 or above and the contrast ratio of the overall display device 24 in which the fill factor of the drive electrodes 31 (i.e. the area of the drive electrodes as a proportion of the area of the display) of 95% is about 30.

Figure 13:
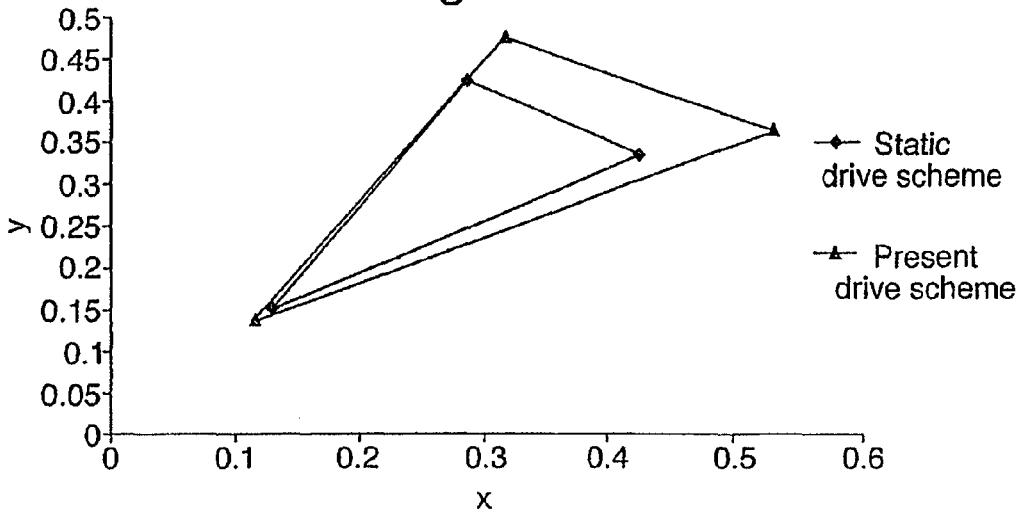
FIG. 13 is a CIE plot of the colour gamuts achievable by a static drive scheme alone and by the present drive scheme.

The colour gamut is also better as follows. In general in a cholesteric display device consisting typically of three stacked cells, the colour of each pixel within a cell is influenced by those pixels above and below it. For example if the lowest pixel has to be at its 100% colour then the pixels above it must be in a transparent state to show the lower pixel optimally. With a known static drive scheme, when the upper pixels are switched into the focal conic state which is largely transparent but not fully transparent, the lower pixels will show a colour that is a mixture of the 100% colour and some white light scattered from upper (or lower) layers. In other words the colour is less saturated than is ideal and the colour gamut is degraded. However, the use of the dynamic drive scheme allows the dark state to have a lower reflectance, hence improving the colour gamut and providing purer colours. This is illustrated in FIG. 13 which is a CIE plot of the colour gamut for the same display device 24 driven solely by a static drive scheme and by the drive described above.

The drive signals of FIGS. 10A to 10C are applied repeatedly in successive frames until the image is changed. Thus power is continuously consumed by pixels having a reflectance in the second portion of the predetermined range. However, in practice the overall power consumption of the display device is relatively low as typical images require only a fraction of the cell 10 to be in the black state, typically of the order of 10% to 15% although this is of course entirely dependent on the nature of the image. The rest of the picture can be driven using a bistable mode.

Various modifications to the drive scheme described above may be made. One possibility is for the dynamic drive scheme to be used to drive pixels to higher reflectances, either by increasing the boundary between the first and second portions of the predetermined range or by making the first and second portions of the predetermined range overlap. However this is not preferred as the dynamic drive scheme consumes more power than the static scheme.

Similarly operation is possible with a restricted range of reflectances, for example by the static drive scheme not using the planar state or the dynamic drive scheme not driving pixels continuously into the homeotropic state, but this is not preferred due to the reduction in the contrast ratio achievable.

The invention claimed is:

1. A method of driving a cholesteric liquid crystal display device which comprises at least one cell comprising a layer of cholesteric liquid crystal material and an electrode arrangement capable of providing driving of a plurality of pixels across the layer of cholesteric liquid crystal material by respective drive signals, the method comprising applying respective drive signals to each pixel to drive the pixels into states which are varied to provide a reflectance varying within a predetermined range of reflectances, the drive signals comprising:

(a) when providing a reflectance in a first portion of the predetermined range of reflectances, a first waveform shaped to drive the pixel into a stable state, the waveform having a shape which is variable to provide a stable state having a varying reflectance; and (b) when providing a reflectance in a second portion of the predetermined range of reflectances which is lower than the first portion, a second waveform shaped to drive the pixel into the homeotropic state and the planar state alternately, the periods of time during which the pixel is driven into the homeotropic and planar states being variable to provide a varying average reflectance as perceived by a viewer.

2. A method according to claim 1, wherein said first waveform comprises:

a reset pulse waveform shaped to drive the pixel into the homeotropic state, followed by a relaxation period to cause the pixel to relax into the planar state, followed by a selection pulse waveform shaped to drive the pixel into a stable state, the selection pulse waveform being variable to drive the pixel into a stable state having a varying reflectance.

3. A method according to claim 2, wherein the selection pulse waveform has an amplitude which is variable.

4. A method according to claim 2, wherein the selection pulse waveform comprises an initial pulse shaped to drive the pixel into one of a plurality of initial stable states, followed by a gap, followed by a tuning pulse shaped to drive the pixel into a final stable state having a reflectance between the reflectances of the initial stable states.

5. A method according to claim 2, wherein the selection pulse waveform comprises an initial pulse shaped to drive the pixel into one of a plurality of initial stable states, followed by a gap, followed by variably either no further pulse to maintain the pixel in the initial stable state or a tuning pulse shaped to drive the pixel into a final stable state having a reflectance between the reflectances of the initial stable states.

6. A method according to claim 5, wherein the initial pulse is of duration 0.6 ms to 100 ms.

7. A method according to claim 5, wherein the tuning pulse is of duration 0.6 ms to 100 ms.

8. A method according to claim 2, wherein the selection pulse waveform comprises a single pulse.

9. A method according to claim 8, wherein the single pulse is of duration 0.6 ms to 100 ms.

10. A method according to claim 2, wherein the reset pulse waveform comprises a single pulse.

11. A method according to claim 1, wherein said second waveform comprises one or more drive pulses shaped to drive the pixel into the homeotropic state alternating with one or more relaxation periods to cause the pixel to relax into the planar state.

12. A method according to claim 11, wherein said second waveform comprises, in each of a plurality of frames of predetermined duration, a single drive pulse shaped to drive the pixel into the homeotropic state followed by a relaxation period to cause the pixel to relax into the planar state.

13. A method according to claim 5, wherein each of the pulses is one selected from the group consisting of a DC pulse, a balanced DC pulse or an AC pulse.

14. A method according to claim 1, wherein the second portion of the predetermined range of reflectances is above the minimum reflectance in the predetermined range of reflectances, and the drive signals further comprise:

(c) when providing the minimum reflectance in the predetermined range of reflectances, a third waveform shaped to drive the pixel into the homeotropic state.

15. A method according to claim 1, wherein the first portion of the predetermined range of reflectances is below the maximum reflectance in the predetermined range of reflectances, and the drive signals further comprise:

(d) when providing the maximum reflectance in the predetermined range of reflectances, a fourth waveform shaped to drive the pixel into the planar state.

16. A method according to claim 1, wherein the drive signals are applied in successive frames of predetermined duration, the first and second waveforms each applied in a respective frame.

17. A method according to claim 1, wherein the electrode arrangement includes a respective conductive layer on each side of the layer of liquid crystal material, at least one of the conductive layers being patterned to provide a plurality of separate drive electrodes each capable of providing independent driving of an area of the layer of liquid crystal material adjacent the respective drive electrode as one of said pixels.

18. A method according to claim 17, wherein one of the conductive layers is patterned to provide said plurality of separate drive electrodes and the other of the conductive layer is shaped as at least one common electrode extending over a plurality of pixels.

19. A method according to claim 17, wherein the at least one of the conductive layers which is patterned to provide a plurality of separate drive electrodes further comprises a separate track connected to each of the separate drive electrodes and extending to a position outside the array of addressable pixels where the tracks form terminals each capable of receiving a respective drive signal.

20. A method according to claim 17, wherein the at least one cell comprises two substrates defining therebetween a cavity in which said a layer of liquid crystal material is disposed, the respective conductive layers each being formed on one of the substrates.

21. A method according to claim 17, wherein the at least one cell further comprises an active matrix drive arrangement comprising a switch device connected to each drive electrode and addressing lines connected to the switch devices for individually addressing the switch devices, the drive signals being applied by addressing the switch devices over the addressing lines.

22. A method according to claim 1, wherein the plurality of pixels comprises a two-dimensional array of pixels.

23. A cholesteric liquid crystal display device comprising:

at least one cell comprising a layer of cholesteric liquid crystal material and an electrode arrangement capable of providing driving of a plurality of pixels across the layer of cholesteric liquid crystal material by respective drive signals; and a drive circuit arranged to apply a respective drive signal to each pixel to drive the pixel into states which are variable to provide a reflectance varying within a predetermined range of reflectances, the drive signals comprising:

(a) when providing a reflectance in a first portion of the predetermined range of reflectances, a first waveform shaped to drive the pixel into a stable state, the waveform having a shape which is variable to provide a stable state having a varying reflectance; and (b) when providing a reflectance in a second portion of the predetermined range of reflectances which is lower than the first portion, a second waveform shaped to drive the pixel into the homeotropic state and the planar state alternately, the periods of time during which the pixel is driven into the homeotropic and planar states being variable to provide a varying average reflectance as perceived by a viewer.

24. A cholesteric liquid crystal display device according to claim 23, wherein said first waveform comprises:

a reset pulse waveform shaped to drive the pixel into the homeotropic state, followed by a relaxation period to cause the pixel to relax into the planar state, followed by a selection pulse waveform shaped to drive the pixel into a stable state, the selection pulse waveform being variable to drive the pixel into a stable state having a varying reflectance.

25. A cholesteric liquid crystal display device according to claim 24, wherein the selection pulse waveform has an amplitude which is variable.

26. A cholesteric liquid crystal display device according to claim 24, wherein the selection pulse waveform comprises an initial pulse shaped to drive the pixel into one of a plurality of initial stable states, followed by a gap, followed by a tuning pulse shaped to drive the pixel into a final stable state having a reflectance between the reflectances of the initial stable states.

27. A cholesteric liquid crystal display device according to claim 24, wherein the selection pulse waveform comprises an initial pulse shaped to drive the pixel into one of a plurality of initial stable states, followed by a gap, followed by variably either no further pulse to maintain the pixel in the initial stable state or a tuning pulse shaped to drive the pixel into a final stable state having a reflectance between the reflectances of the initial stable states.

28. A cholesteric liquid crystal display device according to claim 27, wherein the initial pulse is of duration 0.6 ms to 100 ms.

29. A cholesteric liquid crystal display device according to claim 27, wherein the tuning pulse is of duration 0.6 ms to 100 ms.

30. A cholesteric liquid crystal display device according to claim 24, wherein the selection pulse waveform comprises a single pulse.

31. A cholesteric liquid crystal display device according to claim 30, wherein the single pulse is of duration 0.6 ms to 100 ms.

32. A cholesteric liquid crystal display device according to claim 24, wherein the reset pulse waveform comprises a single pulse.

33. A cholesteric liquid crystal display device according to claim 23, wherein said second waveform comprises one or more drive pulses shaped to drive the pixel into the homeotropic state alternating with one or more relaxation periods to cause the pixel to relax into the planar state.

34. A cholesteric liquid crystal display device according to claim 33, wherein said second waveform comprises, in each of a plurality of frames of predetermined duration, a single drive pulse shaped to drive the pixel into the homeotropic state followed by a relaxation period to cause the pixel to relax into the planar state.

35. A cholesteric liquid crystal display device according to claim 24, wherein each of the pulses is one selected from the group consisting of a DC pulse, a balanced DC pulse or an AC pulse.

36. A cholesteric liquid crystal display device according to claim 23, wherein the second portion of the predetermined range of reflectances is above the minimum reflectance in the predetermined range of reflectances, and the drive signals further comprise:

(c) when providing the minimum reflectance in the predetermined range of reflectances, a third waveform shaped to drive the pixel into the homeotropic state.

37. A cholesteric liquid crystal display device according to claim 23, wherein the first portion of the predetermined range of reflectances is below the maximum reflectance in the predetermined range of reflectances, and the drive signals further comprise:

(d) when providing the maximum reflectance in the predetermined range of reflectances, a fourth waveform shaped to drive the pixel into the planar state.

38. A cholesteric liquid crystal display device according to claim 23, wherein drive circuit is arranged to apply the drive signals in successive frames of predetermined duration, and to apply the first or second waveform in a respective frame.

39. A cholesteric liquid crystal display device according to claim 23, wherein the electrode arrangement includes a respective conductive layer on each side of the layer of liquid crystal material, at least one of the conductive layers being patterned to provide a plurality of separate drive electrodes each capable of providing independent driving of an area of the layer of liquid crystal material adjacent the respective drive electrode as one of said pixels.

40. A cholesteric liquid crystal display device according to claim 39, wherein one of the conductive layers is patterned to provide said plurality of separate drive electrodes and the other of the conductive layer is shaped as at least one common electrode extending over a plurality of pixels.

41. A cholesteric liquid crystal display device according to claim 39, wherein the at least one of the conductive layers which is patterned to provide a plurality of separate drive electrodes further comprises a separate track connected to each of the separate drive electrodes and extending to a position outside the array of addressable pixels where the tracks form terminals each capable of receiving a respective drive signal.

42. A cholesteric liquid crystal display device according to claim 39, wherein the at least one cell comprises two substrates defining therebetween a cavity in which said a layer of liquid crystal material is disposed, the respective conductive layers each being formed on one of the substrates.

43. A cholesteric liquid crystal display device according to claim 39, wherein the at least one cell further comprises an active matrix drive arrangement comprising a switch device connected to each drive electrode and addressing lines connected to the switch devices for individually addressing the switch devices, the drive circuit being connected to the addressing lines and being arranged to apply the drive signals by controlling the switch devices over the addressing lines.

44. A cholesteric liquid crystal display device according to claim 23, wherein the plurality of pixels comprises a two-dimensional array of pixels.

* * * * *